US011058594B2

(12) United States Patent
Yilmaz

(10) Patent No.: US 11,058,594 B2
(45) Date of Patent: Jul. 13, 2021

(54) SYSTEMS AND METHODS FOR REPOSITIONING A PATIENT

(71) Applicant: MedikEquip LLC, Winfield, IL (US)

(72) Inventor: Hakan Yilmaz, Winfield, IL (US)

(73) Assignee: MedikEquip LLC, Winfield, IL (US)

( * ) Notice: Subject to any disclaimer, the term of this patent is extended or adjusted under 35 U.S.C. 154(b) by 206 days.

(21) Appl. No.: 16/267,017

(22) Filed: Feb. 4, 2019

(65) Prior Publication Data

US 2019/0240096 A1 Aug. 8, 2019

Related U.S. Application Data

(63) Continuation-in-part of application No. 15/890,225, filed on Feb. 6, 2018.

(60) Provisional application No. 62/760,231, filed on Nov. 13, 2018.

(51) Int. Cl.
*A61G 7/10* (2006.01)

(52) U.S. Cl.
CPC ..... *A61G 7/1026* (2013.01); *A61G 7/103* (2013.01); *A61G 7/1034* (2013.01); *A61G 7/1055* (2013.01); *A61G 7/1019* (2013.01); *A61G 7/1044* (2013.01); *A61G 7/1046* (2013.01); *A61G 2200/32* (2013.01)

(58) Field of Classification Search
CPC ..... A61G 7/1026; A61G 7/10; A61G 7/1032; A61G 7/1055; A61G 7/1044
See application file for complete search history.

(56) References Cited

U.S. PATENT DOCUMENTS 2,665,432 A 1/1954 Butler et al.
3,108,290 A * 10/1963 Partridge ..... A61G 7/1015 5/88.1
3,769,642 A 11/1973 Warman
4,502,169 A 3/1985 Persson
(Continued)

FOREIGN PATENT DOCUMENTS

WO 1996014817 A1 5/1996
WO 2001030295 A1 5/2001

OTHER PUBLICATIONS

International Search Report dated Apr. 22, 2019 issued in connection with International Application No. PCT/US2019/016544, filed on Feb. 4, 2019, 3 pages.
(Continued)

*Primary Examiner* — Fredrick C Conley
(74) *Attorney, Agent, or Firm* — Vitale, Vickrey, Niro, Solon & Gasey LLP

(57) ABSTRACT

A method and system is provided for repositioning a patient on a transfer surface (e.g., a hospital bed, a stretcher, an imaging system, or the like). The system comprises two rollers positioned on one side of the surface, and a retractable transfer sheet wound around the rollers. The transfer sheet may be unwound from the two rollers to form two layers between the patient and the transfer surface. The patient may then be moved by sliding a top layer of the transfer sheet relative to a second layer of the transfer sheet. After use, the sheet can be retracted around the roller(s), allowing it to be stored in a location that is convenient but out-of-the-way. Such a system may allow a patient to be moved with less force, in less time, with fewer personnel, or with some other benefit.

17 Claims, 7 Drawing Sheets

(56) References Cited

U.S. PATENT DOCUMENTS

| | | | | |
|---|---|---|---|---|
| 4,776,047 | A | 10/1988 | DiMatteo | |
| 5,185,894 | A * | 2/1993 | Bastert | A61G 7/1019 5/81.1 C |
| 6,393,636 | B1 | 5/2002 | Wheeler | |
| 9,655,800 | B1 | 5/2017 | Ferderber | |
| 2002/0083521 | A1 | 7/2002 | Sverdlik et al. | |
| 2004/0231050 | A1 | 11/2004 | Worrell | |
| 2009/0056012 | A1 | 3/2009 | Brossart et al. | |
| 2012/0291196 | A1 | 11/2012 | Konda | |

OTHER PUBLICATIONS

Written Opinion of the International Searching Authority dated Apr. 22, 2019 issued in connection with International Application No. PCT/US2019/016544, filed on Feb. 4, 2019, 6 pages.

Turnaid, "Accessories", http://www.turnaid.dk/en/Accessories, Copyright 2016, 4 pgs. (last visited Feb. 6, 2018).

ICS Medica Supply, "Bariatric Slide Sheet With Large Handles", https://www.icsmedicalsupply.com/products/bariatric-slide-sheet, Copyright 2018, 2 pgs. (last visited Feb. 6, 2018).

* cited by examiner

SYSTEMS AND METHODS FOR REPOSITIONING A PATIENT

CROSS-REFERENCE TO RELATED APPLICATIONS

This application is a continuation-in-part of U.S. patent application Ser. No. 15/890,225, filed Feb. 6, 2018. This application further claims priority to U.S. Provisional Patent Application No. 62/760,231, filed Nov. 13, 2018. The foregoing applications are incorporated herein by reference.

BACKGROUND

Unless otherwise indicated herein, the materials described in this section are not prior art to the claims in this application and are not admitted to be prior art by inclusion in this section.

A patient may be repositioned on a hospital bed by placing a slide sheet between the patient and the hospital bed and sliding the slide sheet across the hospital bed. Typically, slide sheets can be placed under a patient by rolling the patient on their side, placing a first portion of the sheet under the patient, and then rolling the patient on their other side to pull the rest of the sheet under the patient. The patient may then be moved across a hospital bed or from one bed to another by moving the slide sheet relative to the hospital bed.

SUMMARY

The present disclosure generally relates to methods and systems for repositioning a patient on a transfer surface, such as a hospital bed, a stretcher, or another like surface. Such a system could comprise a patient transfer apparatus including two rollers and a retractable low-friction transfer sheet. When unwound from the rollers, the sheet forms two layers between the patient and the transfer surface that can slide against each other with reduced friction. This allows a physician or other user to move the patient across the transfer surface by sliding a first layer of the sheet against a second layer.

In a first implementation, a method is provided. The method includes positioning a patient transfer apparatus proximate to a patient positioned on a transfer surface. The patient transfer apparatus comprises a first roller, a second roller, and a transfer sheet. The first and the second rollers are arranged on one side of the transfer surface. A first end of the transfer sheet is coupled to the first roller, and a second end of the transfer sheet opposite the first end is coupled to the second roller. The method also includes unwinding the transfer sheet from the second roller such that the transfer sheet forms a top layer and a bottom layer beneath the patient and between the patient and the transfer surface. Unwinding the transfer sheet from the second roller comprises sliding the bottom layer of the transfer sheet between the transfer surface and the top layer of the transfer sheet. The method further includes winding the top layer of the transfer sheet around the first roller, thereby moving the patient in a direction toward the first roller, and winding the bottom layer of the transfer sheet around the second roller, thereby retracting the transfer sheet from beneath the patient.

In a second implementation, a system is provided, the system comprising a first roller, a second roller, and a transfer sheet. The first and the second rollers are arranged on one side of the transfer surface. A first end of the transfer sheet is coupled to the first roller and a second end of the transfer sheet opposite the first end is coupled to the second roller, such that the transfer sheet is configured to unwind from the second roller to form a top layer and a bottom layer beneath the patient and between the patient and the transfer surface. The bottom layer of the transfer sheet is configured to slide between the transfer surface and the top layer of the transfer sheet.

Other aspects, embodiments, and implementations will become apparent to those of ordinary skill in the art by reading the following detailed description with reference, where appropriate, to the accompanying drawings.

DETAILED DESCRIPTION

Figure 1:
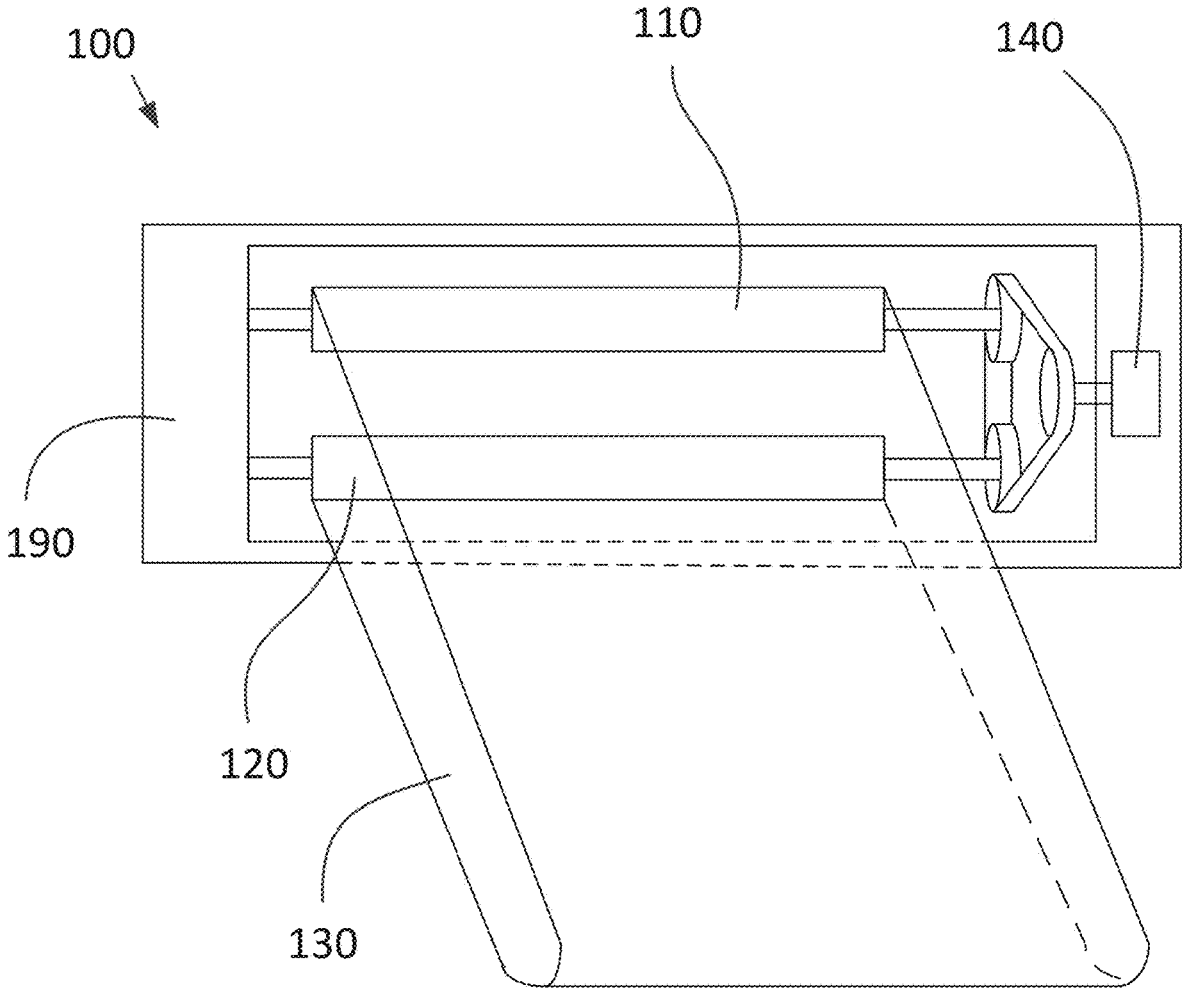
FIG. 1 illustrates a perspective view of a patient transfer apparatus, according to an example embodiment.

Example methods, devices, and systems are presently disclosed. It should be understood that the word "example" is used in the present disclosure to mean "serving as an instance or illustration." Any implementation or feature presently disclosed as being an "example" is not necessarily to be construed as preferred or advantageous over other implementations or features. Other implementations can be utilized, and other changes can be made, without departing from the scope of the subject matter presented in the present disclosure.

Thus, the example implementations presently disclosed are not meant to be limiting. Components presently disclosed and illustrated in the figures can be arranged, substituted, combined, separated, and designed in a wide variety of different configurations, all of which are contemplated in the present disclosure.

Further, unless context suggests otherwise, the features illustrated in each of the figures can be used in combination with one another. Thus, the figures should be generally viewed as components of one or more overall implementations, with the understanding that not all illustrated features are necessary for each implementation.

In an effort to provide technical context for the present disclosure, the information in this section can broadly describe various components of the implementations presently disclosed. However, such information is provided solely for the benefit of the reader and, as such, does not expressly limit the claimed subject matter. Further, components shown in the figures are shown for illustrative purposes only. As such, the illustrations are not to be construed as limiting. As is understood, components can be added, removed, or rearranged without departing from the scope of this disclosure.

I. Overview

For particular applications, it could be desirable to provide a system and method for repositioning a patient. For instance, a user of the system may desire to reposition a patient on a transfer surface (e.g., a hospital bed), move a patient across a transfer surface, or move a patient from one surface to another. It could be beneficial to provide a system which facilitates portions of this patient transfer process. Such systems may allow a physician to move a patient across a transfer surface with less force, in less time, with fewer personnel, with less risk of injury, or with some other benefit.

The system and method of the present disclosure generally relate to a retractable sheet for moving a patient across a surface. The system could comprise an apparatus including two rollers and a transfer sheet, which can be positioned adjacent to a transfer surface. Opposite ends of the transfer sheet could be attached to first and second rollers, such that the sheet may be wound around either the first and/or second roller and unwound around the other roller. Additionally, the sheet can be unwound from both the first and second rollers. When the sheet is unwound from the two rollers and pulled across the transfer surface and under a patient, the transfer sheet forms two layers under the patient: a top layer and a bottom layer. The material that forms the transfer sheet is designed to reduce friction between the two layers of the sheet, allowing the patient to be moved across the transfer surface by sliding the top layer against the bottom layer of the sheet. In some examples, repositioning the patient involves retracting the top layer of the transfer sheet around the first roller, thereby moving the patient in a direction toward the apparatus. Additionally or alternatively, the transfer sheet could be configured to receive air into one or more chambers in the sheet, and the patient could be turned or otherwise repositioned by inflating at least a portion of the transfer sheet. Because of the sheet's reduced-friction properties, the sheet can then be removed from under the patient with ease by retracting the remaining portion of the sheet around the second roller.

The proposed configuration may make the process of moving a patient more convenient by arranging the transfer sheet in an apparatus near a hospital bed, stretcher, gurney, or a similar transfer surface. Similarly, winding the transfer sheet around two rollers may make it easier to pull the sheet under the patient, move the patient in the direction of the roller by retracting the sheet around the roller(s), and store the sheet when not in use. In some examples, the apparatus may further provide a motor for powering the retraction or unwinding of the transfer sheet, allowing a physician or other medical personnel to reposition a patient with less force, in less time, with fewer personnel, or with reduced risk of injury. The double layered design may also provide the advantage of reducing friction when the patient is moved, facilitating the process of placing the sheet under the patient and sliding the patient across the transfer surface. Other implementations and advantages are envisioned by one of ordinary skill in the art.

II. Example System

FIG. 1 illustrates a perspective view of a patient transfer apparatus 100 according to an example embodiment of the present disclosure. The patient transfer apparatus 100 includes a first roller 110 and a second roller 120, which may be held within a housing 190. A transfer sheet 130 is wound around at least one of the first 110 and/or second 120 rollers, such that it may be wound around one roller and unwound around the other roller. In some embodiments, the patient transfer apparatus 100 includes a motor 140, which may be coupled to and/or configured to operate the first 110 and/or second 120 rollers.

The first 110 and second 120 rollers could be any elements configured to move rotationally around an axis such that the transfer sheet 130 may be wound around a roller by rotating the roller around its axis. The rollers 110, 120 may be configured to rotate both clockwise and counterclockwise in order to both wind and unwind the transfer sheet 130. A length of the rollers 110, 120 may be greater than or substantially equal to a width of the transfer sheet 130. The first 110 and second 120 rollers can be arranged at or near one side (i.e., the same side) of a transfer surface, so that, when the transfer sheet 130 is wound around the first 110 and/or second 120 rollers, the transfer sheet 130 can be retracted to the one side of the transfer surface and away from an area of the transfer surface on which a patient may be positioned. The first roller 110 may be disposed above the second roller 120, such that, when the sheet 130 is unwound from the first 110 and/or second 120 rollers and pulled across the transfer surface to form a top layer and a bottom layer of the transfer sheet 130, the top layer is coupled to the first roller 110, and the bottom layer is coupled to the second roller 120. A gap could be provided between the first 110 and second 120 rollers to allow access to a portion of the transfer sheet 130 between the rollers (e.g., to allow a user of the apparatus to pull the portion of transfer sheet to unwind it from the rollers).

The rollers 110, 120 could be held within a housing 190. The first roller 110 and the second roller 120 could be coupled to the housing 190 at their respective axes, such that the position of each roller is fixed in space relative to the other roller, but they may each rotate on their axes independently.

The transfer sheet 130 includes a first end and a second end opposite the first end. In some examples, the first end could be coupled to the first roller 110 and the second end opposite the first end could be coupled to the second roller 120 such that the transfer sheet 130 can be wound around one roller and unwound around the other roller. For example, the transfer sheet 130 can be wound around the first roller 110 while being unwound from the second roller 120, or the transfer sheet 130 can be wound around the second roller 120 while being unwound from the first roller 110. Further, the transfer sheet 130 can be wound around and/or unwound from both the first 110 and second 120 rollers at the same time.

The transfer sheet 130 could be approximately the size of a standard slider sheet. In another example, the transfer sheet 130 could have a width approximately the size of a standard slider sheet and a length double the length of a standard slider sheet, such that, when the transfer sheet 130 is unwound from the rollers 110, 120 and folded over on itself to form a top and bottom layer, the transfer sheet 130 is approximately the size of a standard slider sheet. Depending on the application, size of the patient, and size of the transfer surface, a range of dimension and sizes of the transfer sheet could be envisioned.

The transfer sheet 130 could be configured or designed to have reduced friction, increased water resistance, "breathability", durability, reduced noise during use, or other favorable material properties. In order to facilitate repositioning of the patient, the transfer sheet 130 could be comprised of a low-friction material or a low-friction surface coating. This may make it easier to slide one layer of the transfer sheet 130 against another layer, allowing a user of the apparatus 100 to move a patient with less force, fewer personnel, reduced risk of injury, in less time, or with some other advantage. The transfer sheet 130 could be made from a variety of materials, including but not limited to nylon, polypropylene, or other polymeric materials. A surface of the transfer sheet 130 could further comprise a surface coating, e.g., a coating that reduces friction, protects the sheet from wear, adds water resistance, improves the durability or flexibility of the sheet, or provides some other benefit. A surface coating could be applied to multiple surfaces of the transfer sheet 130, or only to one side of the transfer sheet (e.g., an inward side of the transfer sheet that will be in contact with and slide against itself when the top layer slides against the bottom layer). In one example, the surface could be coated with silicone.

In some examples, the transfer sheet 130 could include an outer trim or hem to prevent fraying and increase durability, or for some other benefit. Additionally or alternatively, the transfer sheet 130 could include handles to facilitate unwinding or winding around the rollers 110, 120, to facilitate repositioning of the patient, or for some other purpose. The handle(s) could be disposed at an outer edge of the transfer sheet 130, for example, along a hem of the transfer sheet. Additionally or alternatively, handle(s) could be disposed at a midpoint of the transfer sheet 130 (i.e., at a point between the first end and the second end of the transfer sheet, or a point disposed between the first 110 and second 120 rollers when the transfer sheet is fully retracted). In such a case, the handles could be pulled to unwind the transfer sheet 130 from the first 110 and/or second 120 rollers.

The transfer sheet 130 could also include one or more chambers formed in the transfer sheet 130 and configured to receive a gas (e.g., air), such that at least a portion of the transfer sheet 130 can be inflated. The one or more chambers could be formed by providing a further layer of the transfer sheet material adhered to the transfer sheet 130 to form an airtight seal between the transfer sheet and the further layer. Such chambers could be formed in the top layer of the transfer sheet and/or the bottom of the transfer sheet, and could take any desired shape including, e.g., longitudinal channels or pockets in any shape or combination of shapes. In a particular example, the transfer sheet 130 includes a left side chamber and a right side chamber formed such that they are disposed approximately beneath a patient positioned on the transfer sheet (i.e., so inflating the left and/or right side chamber causes the patient to be lifted on their left and/or right side, respectively). In such examples, the transfer sheet 130 could also include one or more entrance ports (e.g., grommets or eyelets) in fluid communication with the one or more chambers, such that air that enters through an entrance port is directed into one or more corresponding chambers.

The transfer sheet 130 could be configured to be a single-use sheet (i.e., used for a single repositioning of a single patient) or could be used for multiple repositionings of the same patient (i.e., single-patient use). Such a transfer sheet 130 could be configured to be disposable and/or recyclable. Additionally or alternatively, the transfer sheet 130 could be configured for use on a plurality of patients, and the transfer sheet 130 could be cleaned or washed between uses or between patients.

To facilitate removal of the transfer sheet 130 (e.g., to replace a used transfer sheet with a new sheet), the transfer sheet 130 could be detachable from the first 110 and/or second 120 rollers. In such an example, a first end of the transfer sheet 130 may be removably coupled to the first roller 110, while the second end of the transfer sheet may be removably coupled to the second roller 120. Removable coupling of the transfer sheet 130 could include coupling the transfer sheet to the first 110 and/or second 120 rollers with a hook and loop attachment (e.g., Velcro brand), an adhesive, a hook, a clamp, a tie, or some other means for reversible coupling.

Additionally or alternatively, replacing the transfer sheet 130 could include replacing the first 110 and/or second 120 rollers of the apparatus 100. In such a configuration, the transfer sheet 130 could be designed or sold pre-wound onto a roller, such that replacing the sheet 130 comprises removing an existing roller on which the transfer sheet 130 is wound, and coupling a new roller containing a new transfer sheet to the apparatus 100. If, for example, the second roller 120 comprises the replacement transfer sheet, replacing the transfer sheet 130 could include coupling a new second roller to the housing. Replacing the transfer sheet 130 could further include coupling a free end of the transfer sheet (e.g., a first end or a second end) to the other roller (in this scenario, the first roller 110), thereby allowing the new transfer sheet 130 to be unwound from the second roller 120 and wound around the first roller 110. The reverse configuration is also possible, wherein replacing the transfer sheet 130 comprises removing an existing first roller 110, coupling a new first roller comprising a new transfer sheet to the apparatus 100, and attaching a free end of the new transfer sheet to the second roller 120. Other configurations are envisioned by one with ordinary skill in the art.

Figure 2:
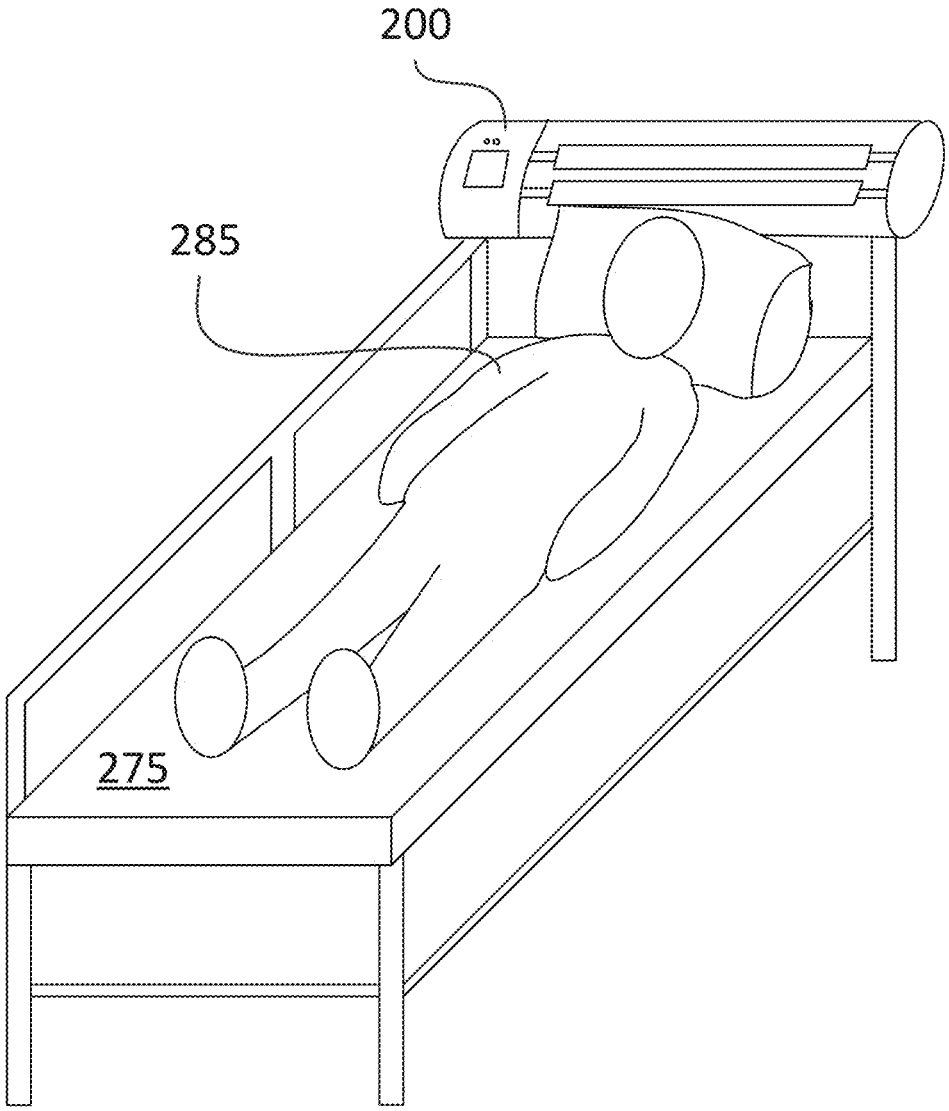
FIG. 2 illustrates a perspective view of a patient transfer apparatus coupled to a patient bed, according to an example embodiment.

FIG. 2 illustrates a patient transfer apparatus 200 positioned proximate to a patient 285 positioned on a transfer surface 275, according to an embodiment of the present disclosure. The patient transfer apparatus 200 depicted in FIG. 2 can be similar to or the same as the patient transfer apparatus 100 depicted in FIG. 1. The transfer surface 275 could be, for instance, the top surface of a patient bed, a hospital bed, a stretcher, a full-body imaging system, or the like. The apparatus 200 could be positioned relative to the transfer surface 275 to facilitate unwinding of the transfer sheet across the transfer surface 275 and/or repositioning of the patient 285 on the transfer surface 275. For instance, the apparatus 200 could be positioned such that the first and/or second roller is approximately the same height relative to the transfer surface 275, higher than the transfer surface 275, or lower than the transfer surface, according to the particular application. Positioning the apparatus 200 proximate to the transfer surface 275 could include detachably coupling the apparatus 200 to a side of the transfer surface (e.g., a patient bed or another like surface on which the patient 285 is positioned). Detachably coupling, as described herein, could mean positioning or securing the apparatus 200 proximate to the transfer surface 275 such that it is substantially stable during use, but can be later removed (e.g., in order to reposition the apparatus 200 proximate a different transfer surface). To facilitate positioning of the patient transfer apparatus 200, the housing or another element of the apparatus 200 could include an attachment mechanism. For example, the patient transfer apparatus 200 could include one or more clamps, hook and loop fasteners, ties, or other means for attachment. In a particular example, positioning the patient transfer apparatus proximate to the transfer surface comprises securing the apparatus with a clamp.

In another embodiment, the patient transfer apparatus 200 could be disposed on a stand (e.g., a wheeled stand, a tripod, or another support) and positioning the apparatus proximate to the patient 285 positioned on the transfer surface 275 could include placing or rolling the stand proximate to the transfer surface 275. Additionally or alternatively, the patient transfer apparatus 200 could be disposed on an armature (e.g., an armature coupled to the transfer surface 275, or a different device) and positioning the apparatus 200 could include moving the armature proximate to the patient 285 and/or transfer surface 275.

In some cases, the patient transfer apparatus 200 may form part of a system comprising the transfer surface 275 or be irreversibly coupled to the transfer surface 275. For example, a patient bed, a hospital bed, a stretcher, or another like surface could be designed to include the patient transfer apparatus 200, disposed at an appropriate location relative to the patient 285 and transfer surface 275. In such an example, positioning the patient transfer apparatus 200 proximate to the patient 285 could include positioning the patient transfer apparatus 200 on the transfer surface 275.

Figure 3A:
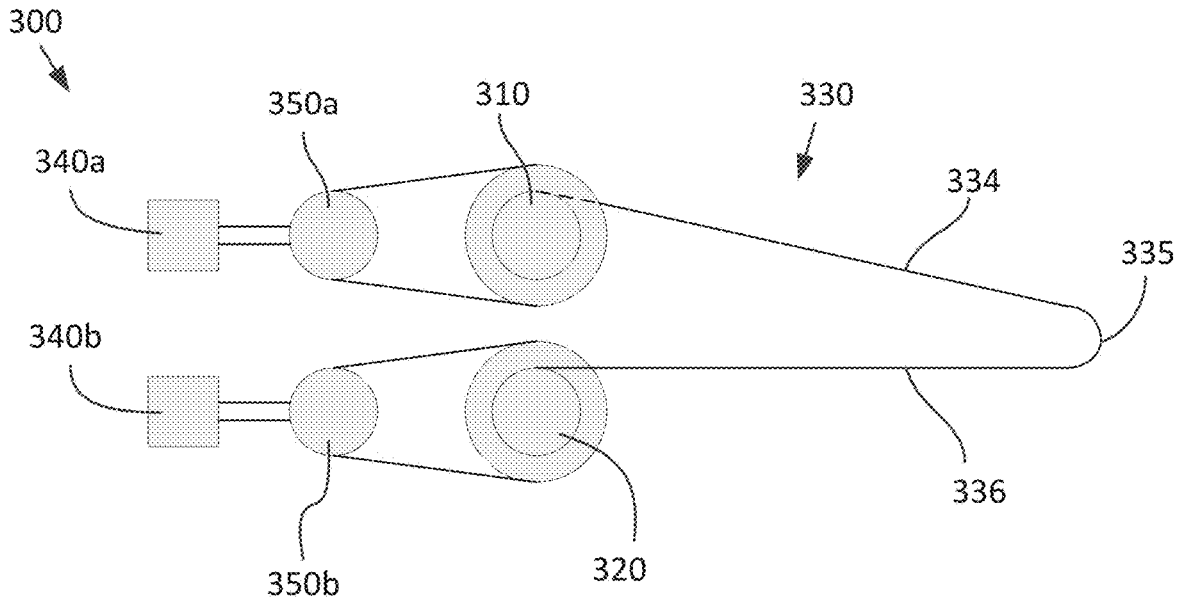
FIG. 3A illustrates a sectional view of a patient transfer apparatus, according to an example embodiment.
Figure 3B:
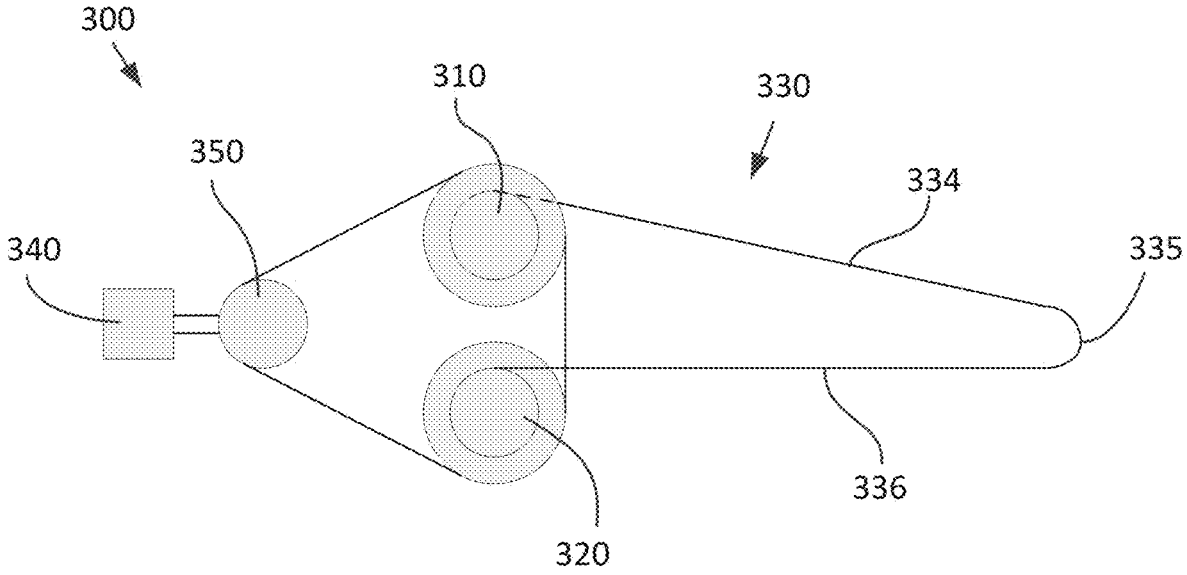
FIG. 3B illustrates a sectional view of a patient transfer apparatus, according to another example embodiment.
Figure 3C:
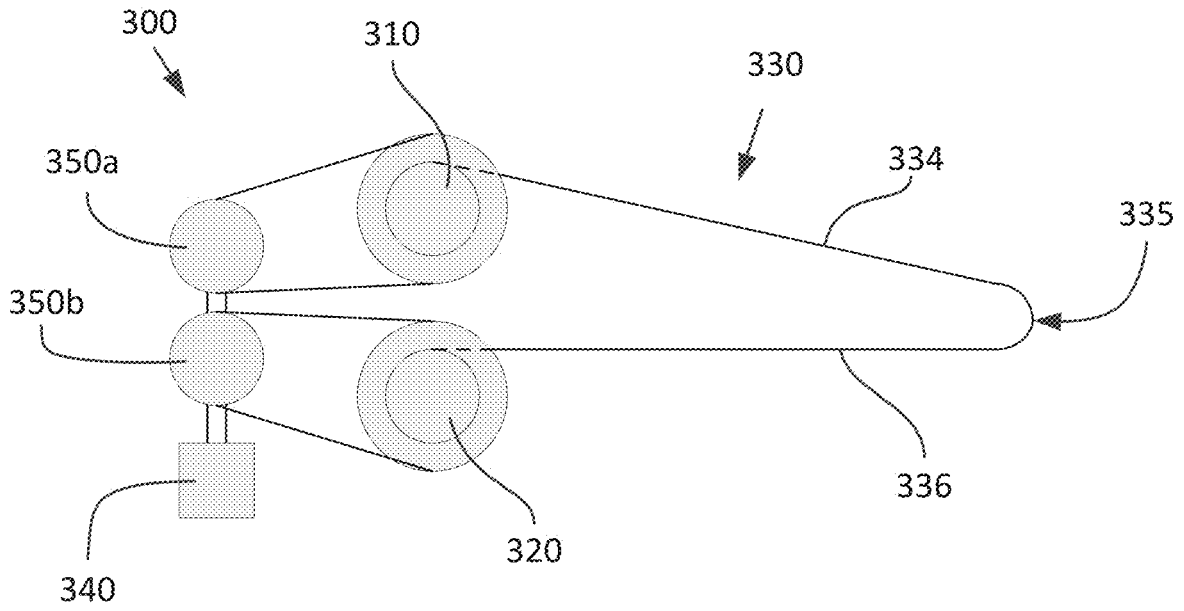
FIG. 3C illustrates a sectional view of a patient transfer apparatus, according to yet another example embodiment.

Once the apparatus 200 is positioned proximate to the patient 285, the transfer sheet can be unwound from rollers. FIGS. 3A-C illustrate a few non-limiting examples of a patient transfer apparatus 300, according to the present disclosure, shown with the transfer sheet at least partially unwound from rollers 310, 320. With the two rollers 310, 320 disposed on one side of the transfer surface, unwinding the sheet 330 from the first and/or second rollers while the ends of the sheet remain attached to the rollers can result in the formation of two layers on the transfer surface. In a particular example, unwinding the transfer sheet 330 from the second roller 320 may cause the transfer sheet to form a top layer 334 and a bottom layer 336 beneath the patient and between the patient and the transfer surface. Unwinding the transfer sheet 330 from the second roller 320 could comprise sliding the bottom layer 336 of the transfer sheet between the transfer surface and the top layer 334 of the transfer sheet. When unwound, the top layer 334 and bottom layer 336 may be joined at a fold 335 at, e.g., the end of the transfer surface opposite the apparatus 300.

The top 334 and bottom 336 layers could be configured to slide against each other with low or reduced friction. The reduced friction between the layers 334, 336 of the transfer sheet 330 allows a user of the apparatus 300 to move or reposition a patient with reduced effort. In one embodiment, a physician or user of the device 300 could slide the top layer 334 of the transfer sheet against the bottom layer 336 of the transfer sheet to manually move the patient in whatever desired direction (e.g., in a similar manner as a standard slider sheet). Moving or repositioning the patient toward the patient transfer apparatus 300 could be facilitated by winding the transfer sheet 330 around the first roller 310. In some examples, winding the transfer sheet 330 around the first roller 310 may move the patient in a direction toward the first roller 310.

Figure 6:
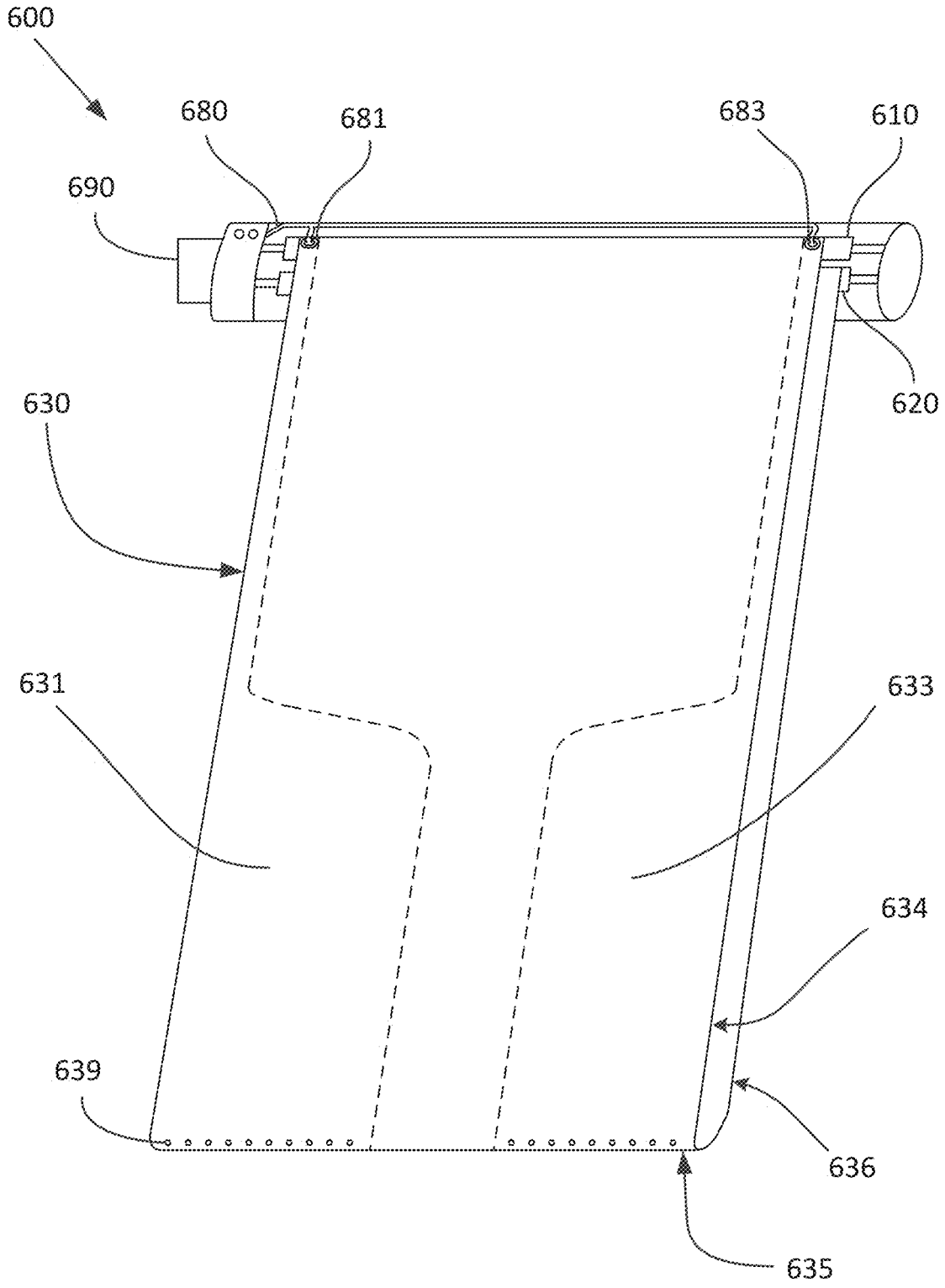
FIG. 6 illustrates a perspective view of a patient transfer apparatus, according to an example embodiment.

In some examples, a patient may additionally be repositioned by inflating at least a portion of the transfer sheet. Inflating a portion of the transfer sheet could cause a patient positioned on the sheet to be lifted, turned, or otherwise moved in order to, e.g., facilitate the changing of bedding or the repositioning of the patient on the patient bed. FIG. 6 illustrates an example patient transfer apparatus 600, including an inflatable transfer sheet 630 with chambers 631, 633, and an air compressor 690 configured to direct air into the chambers 631, 633 of the transfer sheet 630. As seen in FIG. 6, the transfer sheet 330 may be made inflatable (i.e., capable of receiving air or another gas) by providing chambers (e.g., 631, 633), pockets, channels, and/or additional layer(s) of transfer sheet material along at least a portion of the top layer 634 or bottom layer 636 of the transfer sheet 630 thereby forming an airtight volume within the sheet 630. In a particular example, the top layer 634 of the transfer sheet comprises a further layer of the transfer sheet material adhered (e.g., melted, sewn, or attached by way of an adhesive) to the top layer 634 so as to form airtight chambers 631, 633 configured to receive air between the top layer 634 and the further layer.

The chambers 631, 633 in the transfer sheet 630 could be formed in a variety of shapes, for instance, in channels, pockets, or any other desired shape or combination of shapes. In order to facilitate lifting and repositioning of the patient, in certain cases the chambers 631, 633 may take a shape that most optimally positions the air beneath the patient or a portion of the patient. For instance, the chambers 631, 633 could be formed in the transfer sheet 630 at a location that is approximately under a patient's hips when the transfer sheet 630 is fully retracted beneath the patient. Longitudinal channels may be provided in the transfer sheet (e.g., longitudinal channels running along an edge or edges of the sheet) to direct the air from an entrance port(s) 681, 683 of the sheet 630 to the one or more chambers 631, 633 in the transfer sheet 630.

In some cases, the airtight chamber includes a left side chamber 631 and a right side chamber 633 which may be inflated independently, such that a patient can be controllably lifted on their right or left side, i.e., to facilitate turning of the patient. The left side 631 and right side 633 chambers may be formed in any desired shape, and may take the same or different shapes. For instance, the left side chamber 631 and right side chamber 633 could include approximately "b" and "d" shaped chambers, respectively. Such chambers 631, 633 could include respective longitudinal channels extending from respective entrance ports 681, 683 and leading to larger pockets disposed approximately under a patient's hips, back, or legs. However, one of ordinary skill in the art would readily understand that a chamber or chambers could be provided in the transfer sheet 630 in any desired shape so as to locate air beneath the patient to help with repositioning the patient.

In order to inflate the transfer sheet 630, air may be forced into the sheet 630 using an air compressor 690 or another means for forcing air into the chambers 631, 633 in the transfer sheet 630. In some cases, compressed air or another compressed gas (e.g., nitrogen gas) may be forced into the transfer sheet 630 from a pressurized tank including a regulator configured to regulate the pressure flow of the gas, the gas flow rate, or some other parameter. Air or another gas could enter the sheet through at least one entrance port 681, 683, for instance, a grommet, and/or eyelet disposed in the sheet and configured to form an air tight seal with a conduit 680. The entrance port(s) 681, 683 could be disposed anywhere on the transfer sheet 630, but may preferably be disposed near the end of the transfer sheet 630 that is coupled to the first roller 610 and/or second roller 620 of the patient transfer apparatus 600. In examples including a plurality of chambers 631, 633, there may be a corresponding number of entrance ports 681, 683 leading to the respective chambers (e.g., a first entrance port 681 leading to a left side chamber 631 and a second entrance port 683 leading to a right side chamber 633). An airtight conduit 680 may be provided between the compressor 690 and the entrance port(s) 681, 683 such that gas may flow from the compressor 690, through the conduit 680, and into the entrance port(s) 681, 683 of the transfer sheet 630. The conduit 680 may be disposed in any desired location, for instance, inside a housing of the device 600, inside the first 610 or second 620 rollers or an axle thereof, at a location outside of the housing of the device or distal to the device, or in some other location.

Air may leave the chamber(s) 631, 633 in the transfer sheet 630 by way of one or more holes 639 disposed in the one or more chambers 631, 633 of the transfer sheet 630. The hole(s) 639 may be sized such that air leaves the chambers 631, 633 in the transfer sheet 630 at approximately the same rate that air enters the chambers via the entrance ports 681, 683, i.e., at the same rate the air compressor 690 forces the air into the transfer sheet 630, such that a steady state of inflation is maintained in the sheet. The holes 639 should be located such that air forced into the transfer sheet 630 must pass at least partially under the patient, thereby inflating the portion of the sheet under the patient, before exiting the sheet 630 through the holes 639. Depending on the size and configuration of the chambers 631, 633, the holes may be located at any desired location on the transfer sheet 630. For example, the holes 639 may be located on the bottom layer of the sheet 636, at approximately the location of a fold 635 of the transfer sheet (i.e., where the top 634 and bottom 636 layer of the sheet meet), on the top layer of the sheet 634, or at some other location that comprises part of one or more of the chambers 631, 633. In examples where the chambers 631, 633 are formed by a further layer of transfer sheet material adhered to the top layer 634 and/or bottom layer 636, the holes 639 could be located on the further layer of the transfer sheet 630.

Returning to FIG. 3, after repositioning the patient manually and/or by way of inflation, the transfer sheet 330 can be retracted from underneath the patient and removed from the transfer surface. Retracting the transfer sheet 330 may include winding an amount of the transfer sheet (e.g., the top 334 and/or bottom 336 layers of the sheet) around the first 310 and/or second 320 rollers. In one example, the bottom layer 336 of the transfer sheet 330 could be wound around the second roller 320, thereby retracting the transfer sheet from beneath the patient. In another example, a predetermined amount of the transfer sheet 330 could be configured to be wound around each roller, and retracting the sheet could include winding a predetermined amount of the transfer sheet around the first roller 310 and the second roller 320, respectively. Other retraction schemes could be envisioned by one or ordinary skill in the art.

The device 300 could also include one or more motors 340 or other electromechanical actuators configured to apply driving and/or retracting force(s) to rotate the first 310 and/or second 320 rollers. Such a motor 340 could power the winding and/or unwinding of the transfer sheet 330, thus facilitating patient repositioning and/or retracting of the transfer sheet. The motor(s) 340 may be coupled to the rollers 310, 320 by way of a series of pulleys 350 and clutch bearings that could allow the motor(s) 340 to selectively control one or more rollers independently. In some examples, the motor 340 is a stepper motor. In a more particular example, the motor 340 could be a switched reluctance type stepper motor. As apparent to one of ordinary skill in the art, a variety of configurations could allow for the powering of the first 310 and/or second 320 roller by a motor 340 or plurality of motors 340*a*, 340*b*.

In one example, a motor 340 could be coupled to at least the first roller 310 and used to power the retraction of the transfer sheet 330 around the first roller 310. In such an example, winding the top layer 334 of the transfer sheet 330 around the first roller 310 could include actuating the motor 340 to wind the transfer sheet around the first roller, thereby moving the patient in a direction toward the first roller 310. Such a configuration would allow a user of the apparatus 300 to reposition a patient in the direction of the first roller 310 with less force, fewer personnel, reduced risk of injury, in less time, or with some other benefit. In some embodiments, the motor 340 could be operable to rotate the first roller 310 in either a clockwise or counterclockwise direction, thereby allowing a user to power the unwinding of the transfer sheet 330 from the first roller 310.

In some examples, a motor 340 may be coupled to and used to power the second roller 320. This motor 340 could be the same motor used to power the first roller 310 or a separate motor. The motor 340 may then be actuated to wind of the bottom layer 336 of the transfer sheet 330 around the second roller 320, thereby retracting the transfer sheet (i.e., such that the transfer sheet is removed from beneath the patient). This could allow a user of the apparatus 300 to quickly and easily remove the transfer sheet 330 from the transfer surface (e.g., to remove the sheet without the need to turn the patient, without additional personnel, without manually pulling the sheet, or with some other benefit). Additionally or alternatively, the motor 340 could be operable to rotate the second roller 320 in a direction that unwinds the transfer sheet 330 from the bottom roller. In such a configuration, a user of the apparatus 300 may actuate the motor 340 to unwind the transfer sheet 330 from the second roller 320.

Referring back to FIG. 3A, in some instances the patient transfer apparatus 300 could include a first motor 340*a*, operable to power the first roller 310, and a second motor 340*b*, operable to power the second roller 320. In such a configuration, the first 310 and second 320 rollers can be rotated independently by selectively actuating (e.g., powering) the first 340*a* and/or second 340*b* motors. In some embodiments, the first 340*a* and second 340*b* motor could be coupled to the first 310 and second 320 roller by way of a first 350*a* and second 350*b* pulley, respectively. The apparatus 300 could further include a clutch (i.e., a clutch bearing) coupled to the pulleys 350*a*, 350*b*; motors 340*a*, 340*b*, a drive shaft, or another element of the apparatus 300. Such a clutch may add an additional layer of control to the winding and/or unwinding of the transfer sheet 330 from the first 310 and/or second 320 rollers.

Referring to FIG. 3B, in some examples, a single motor (e.g., motor 340) could be coupled to and operable to rotate both the first 310 and second 320 rollers. In such a configuration, the motor 340 could include one or more clutch such that the motor can rotate the first roller 310 and the second roller 320 independently. The clutch could be coupled to the motor 340, the first 310 and second 320 rollers, and/or a pulley(s) 350 coupled to the motor or rollers. As described herein, the clutch may be operable to selectively engage and disengage the rollers 310, 320 and/or pulley(s) 350 such that they can be controlled independently (i.e., the first roller 310 can be rotated to wind or unwind the transfer sheet 330 without rotating the second roller 320, and vice versa). When such a clutch is engaged, powering the motor 340 can cause the first 310 and/or second 320 rollers to rotate, thereby winding or unwinding the transfer sheet 330. Conversely, when the clutch is disengaged from the first 310 and/or second 320 rollers, the roller(s) may rotate freely (allowing a user to, e.g., manually wind or unwind the transfer sheet 330 from the roller(s)).

Referring to FIG. 3C, in still another embodiment, a single motor (e.g., motor 340) may be coupled to a plurality of pulleys 350*a*, 350*b* in order to control a first 310 and second 320 roller by way of a single motor. Such a single-motor embodiment may reduce the cost of using the device, the power used, or provide some other benefit. In a particular example, a motor 340 could be coupled to a first pulley 340*a* and a second pulley 340*b*, wherein the first pulley 340*a* is coupled to the first roller 310 and the second pulley 340*b* is coupled to the second roller 320. Like previous embodiments, a clutch may be used to selectively engage/disengage elements of the apparatus 300 such that the first 310 and second 320 rollers can be operated independently to wind and/or unwind the transfer sheet 330. In varying examples, the clutch could be coupled to the motor 340, the first 350*a* and/or second 350*b* pulleys, the first 310 and/or second 320 rollers, a drive shaft or another element of the apparatus 300.

Figure 4:
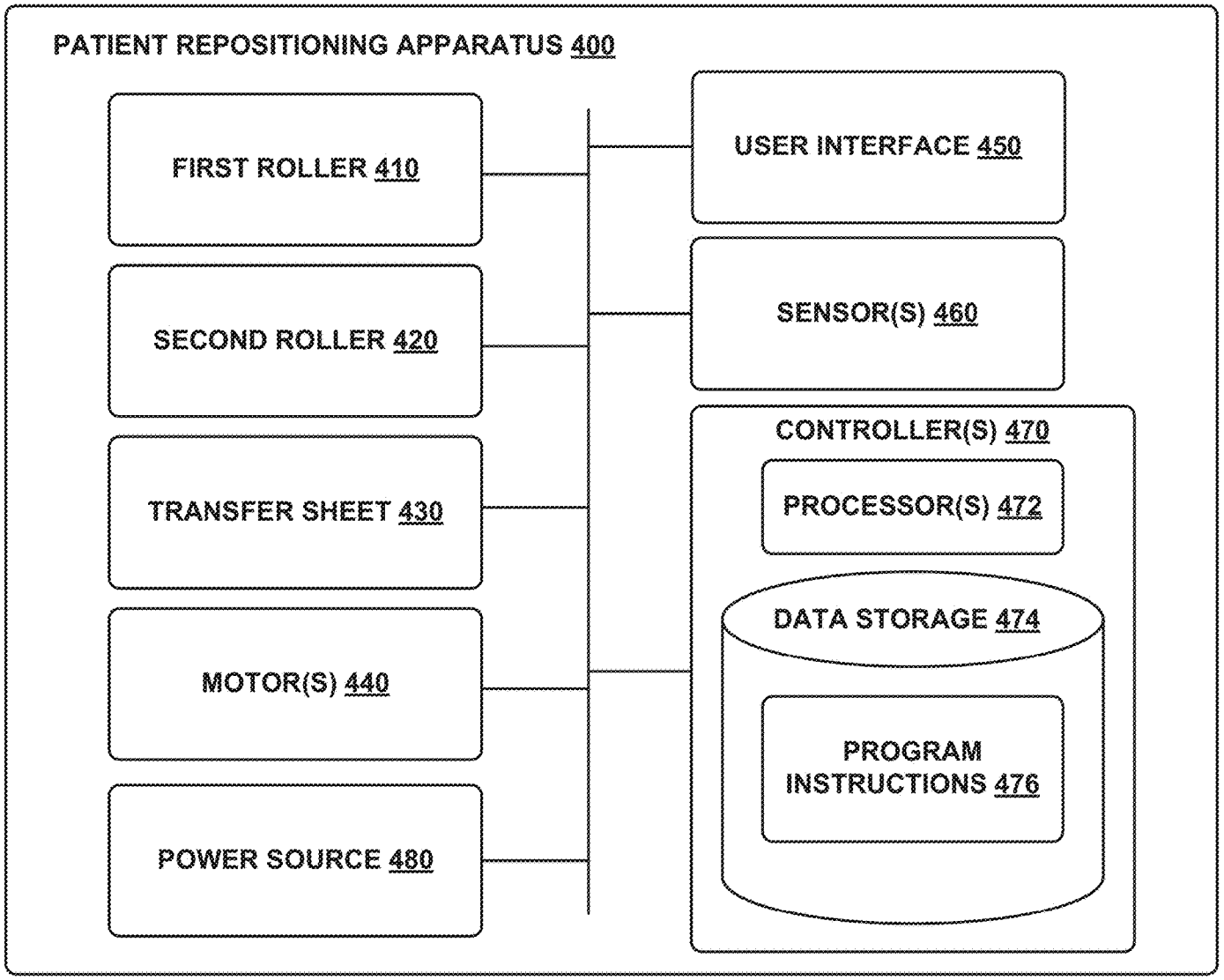
FIG. 4 illustrates a block diagram of a patient transfer apparatus, according to an example embodiment.

FIG. 4 illustrates a block diagram of a patient transfer apparatus 400 according to the present disclosure. The patient transfer apparatus 400 includes a first roller 410, a second roller 420, a transfer sheet 430, one or more motors 440, a user interface 450, and controller(s) 470. The controller(s) 470 include one or more processors 472, which can include or take the form of a central processing unit (CPU), such as one or more general purpose processors and/or one or more dedicated processors (e.g., application specific integrated circuits (ASICs) or digital signal processors (DSPs), etc.). The controller(s) 470 further include data storage 474, which can include or take the form of one or more non-transitory computer-readable storage media that can be read or accessed by the processor(s) 472. The one or more computer-readable storage media can include volatile and/or non-volatile storage components, such as optical, magnetic, organic, or other memory or disc storage. In some examples, the data storage 474 can be implemented using a single physical device (e.g., one optical, magnetic, organic, or other memory or disc storage unit), while in other examples, the data storage 474 can be implemented using two or more physical devices.

The processor(s) 472 can be configured to execute computer-readable program instructions 476 that are stored in the data storage 474 and are executable to provide some or all of the functionality described herein. For instance, in line with the discussion above, the processor(s) 472 can execute the computer-readable program instructions 476 to control various aspects of the winding and/or unwinding of the transfer sheet 430 from the rollers 410, 420. In various embodiments, the computer-readable program instructions could include instructions to operate the rollers 410, 420 according to a predetermined scheme, in response to data from a sensor, or in response to data from a user interface 450. In one example, it may be desirable to stop the motor 440 automatically when the transfer sheet 430 is fully unwound from the first 410 and/or second 420 rollers. In such an example, the controller 470 could include a sensor 460 configured to detect when the transfer sheet 430 is fully unwound from the first 410 and second 420 rollers and, responsive to detecting the transfer sheet is fully unwound, stop the motor 440 and/or disengage the clutch.

In a similar example, the controller 470 could be operable to stop the motor 440 when the transfer sheet 430 is fully wound around the first 410 and second 420 rollers (i.e., fully retracted). In such an example, the sensor 460 could be configured to determine when the transfer sheet 430 is fully retracted, and, responsive to the determination, stop the motor 440 and/or disengage the clutch. In one example, substantially the entire transfer sheet 430 could be configured to be would around the second roller 420, and the controller 470 could be operable to stop the second roller 420 (by stopping power to a motor 440 coupled to the second roller, by disengaging a clutch on the second roller or a pulley coupled to the second roller, or by some other means) when the transfer sheet 430 is fully wound around the second roller 420. In another example, the transfer sheet 430 could be configured to be partially wound around both the first 410 and second 420 rollers when the sheet is retracted (i.e., a predetermined portion of the transfer sheet is wound around each of the first and second rollers when the sheet is fully retracted). In such an example, the controller 470 could be operable to stop the second roller 420 (e.g., by any of the means previously mentioned) when a predetermined portion of the transfer sheet 430 is wound around the second roller 420.

In some examples, the controller 470 may also be used to controllably inflate the one or more inflatable chamber(s) provided in the transfer sheet 430. For example, the controller could be operable to power an air compressor in fluid communication with the chamber(s) in the transfer sheet (by way of an air conduit and/or an entrance port). In some examples, the controller could be configured to inflate the one or more chambers (e.g., a right side chamber and a left side chamber) in a predetermined order or at a predetermined time. The controller could be further configured to prevent the inflation of the one or more chambers while the transfer sheet 430 is wound around either the first 410 and/or second 420 rollers, such that the transfer sheet 430 can only be inflated when the sheet is fully retracted and positioned under a patient.

A controller 470 could also function to change a speed of rotation of one or both rollers 410, 420, engage or disengage a clutch of one or more of the rollers, actuate some other element, change a flow of air into the transfer sheet 430, or change a setting of the apparatus 400. Such a controller may be operable to affect elements or change various settings of the apparatus 400 responsive to a user input on a user interface 450 of the apparatus 400. The user interface 450 could include one or more buttons, switches, dials, a touch pad, a display, and/or a touch screen. The user interface 450 may enable a user of the apparatus 400 to interact in various ways with elements of the apparatus 400. For example, the user interface may include hardware and/or software configured to control the motor(s) 440, rollers 410, 420, air compressor, and/or the clutch. In some examples, the user interface 450 could include one or more input controls (e.g., buttons, switches, dials, or controls on a touchscreen) configured to actuate the motor(s) 440, thereby powering the winding and/or unwinding of the transfer sheet 430 from the first 410 and/or second 420 rollers. In particular, the user interface 450 could include an input control configured to retract the sheet from under the patient and wind it around the second roller (i.e., a pull function), and another input control for winding the transfer sheet around the first roller (i.e., to boost the patient). Additionally or alternatively, a user interface 450 of the apparatus 400 could be configured to engage or disengage the clutch, thereby allowing a user to select which roller is being actuated at a given time. The user interface 450 could further include one or more input controls to selectively inflate a particular chamber formed in the transfer sheet in order to, e.g., selectively lift or reposition a particular side of the patient. In a particular embodiment, the user interface 450 could include an input control for filling a left side chamber of the transfer sheet with air, another input control for filling a right side chamber of the transfer sheet with air, and yet another input control for filling both and/or all chambers of the transfer sheet with air. Further configurations and functions of the user interface 450 may be envisioned by one or ordinary skill in the art.

The patient transfer apparatus 400 could further comprise a power source 480 configured to power the motor(s) 440, a user interface 450, an air compressor, and/or other powered elements of the system. The power source 480 could be a wall outlet or another wired power source. In another example, the apparatus 400 could take power from an associated device proximate to the patient repositioning apparatus 400, and powering the apparatus could involve connecting the apparatus to the associated device. In a particular example, the patient repositioning apparatus 400 could be positioned proximate to an electric hospital bed (e.g., a hospital bed that is powered to aid in movement, adjustment, or other functions of the bed) and the apparatus 400 could receive power from the electric hospital bed. To improve portability of the apparatus 400, the power source 480 could be a battery disposed e.g., within the housing of the apparatus. The battery could be used as a main power source, or could be used as a back-up power, such that the apparatus receives power from the battery when no other power source is available.

Additionally or alternatively, the first 410 and/or second 420 rollers could be powered by a mechanical actuator. In such an example, the apparatus 400 could include a mechanical actuator, and winding the transfer sheet 430 around the roller(s) 410, 420 could include winding the sheet 430 using a mechanical actuator. In some example, the mechanical actuator could be powered manually (i.e., by a user of the apparatus). In a particular example, the mechanical actuator could include a crank coupled to the first and/or second roller(s) 410, 420, and winding and/or unwinding the transfer sheet 430 could be controlled by turning the crank. The mechanical actuator could also include a foot pedal, a spring, a button, or any other actuator configured to rotate a roller by way of a force imparted by a user.

In some alternative embodiments, retraction of the transfer sheet 430 around the first 410 and/or second 420 rollers could be powered by a spring mechanism. Such a spring mechanism could operate similarly to e.g., retractable blinds, wherein the spring gains potential energy and becomes tighter as the transfer sheet 430 is unwound from the roller(s) 410, 420. Subsequent retraction of the transfer sheet 430 can then be powered by releasing the energy held in the spring, causing the sheet to wind around the first 410 and/or second 420 rollers. In such an embodiment, the first 410 and/or second 420 roller could comprise a spring, and unwinding the transfer sheet from the second roller could cause the spring to gain potential energy. Winding the bottom layer of the transfer sheet 430 around the second roller 420 could comprise releasing the potential energy from the spring, thereby retracting the transfer sheet 430 from under the patient. In such an example, the transfer sheet 430 could be configured to wind around the first 410 and/or second 420 roller(s) responsive to, e.g., a tug of the transfer sheet 430, or another physical movement of the sheet (i.e., such that the retraction of the sheet is initiated similarly to retractable blinds). Other means of winding and/or unwinding the transfer sheet 430 from the rollers 410, 420 are envisioned by one with ordinary skill in the art.

III. Example Method

Figure 5:
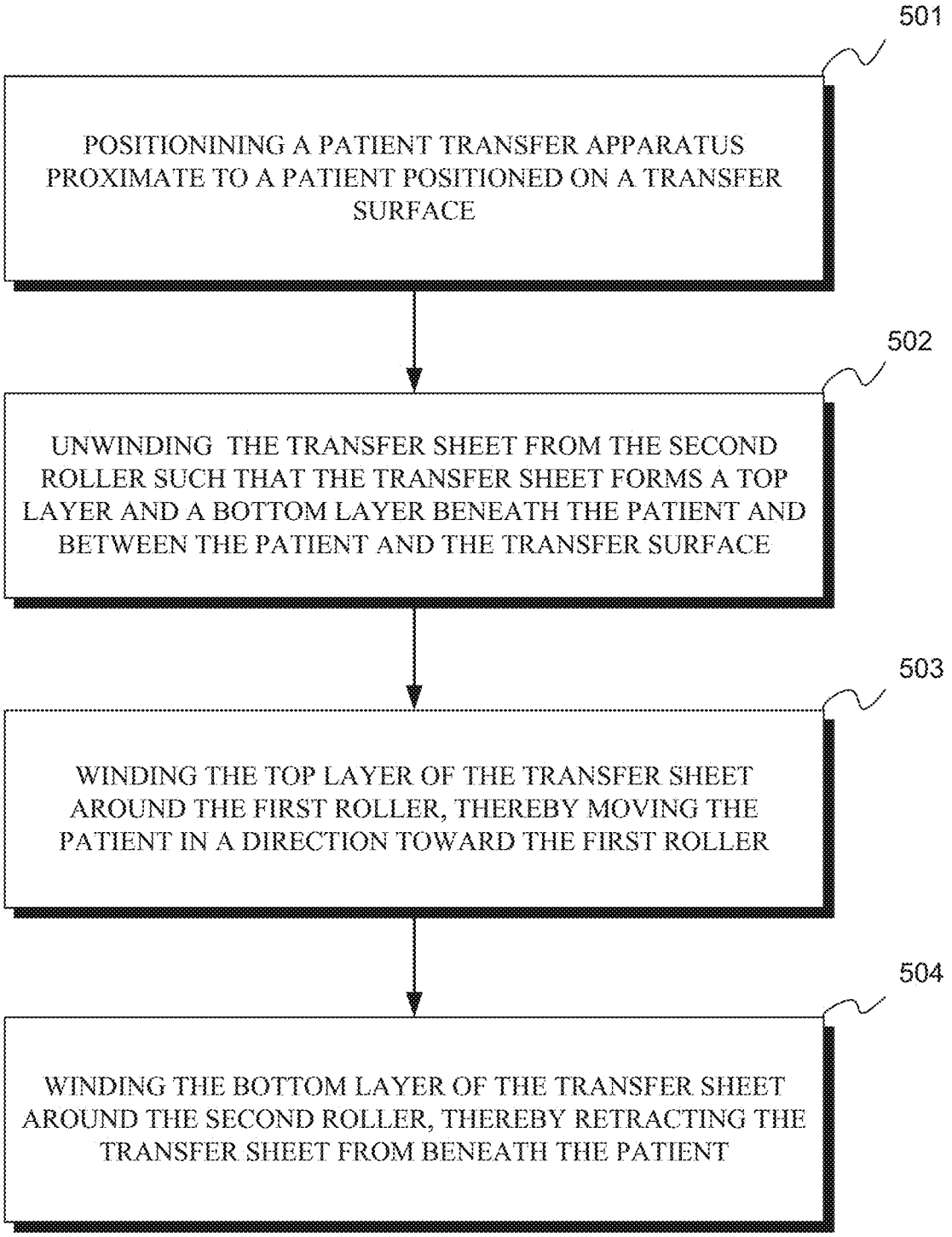
FIG. 5 illustrates a flow chart of a method.

FIG. 5 illustrates a flowchart of a method 500 for operating a patient repositioning system, such as any of the apparatuses shown in FIGS. 1, 2A-B, 3A-C, or 4 and described herein. For purposes of illustration, the patient transfer apparatus operated in method 500 includes a first roller, a second roller, and a transfer sheet. The first roller and second roller can be arranged on one side of a transfer surface, with a first end of the transfer sheet coupled to the first roller and a second end of the transfer sheet opposite the first end coupled to the second roller. The transfer sheet is configured to unwind from the second roller to form a top layer and a bottom layer beneath the patient and between the patient and the transfer surface. The top layer of the transfer sheet is configured to slide toward the first roller, moving the patient in the direction of the first roller. The bottom layer of the transfer sheet is configured to slide between the transfer surface and the top layer of the transfer sheet.

A first portion of the method could include placing the apparatus near a patient and/or surface in order to move the patient in the direction of the apparatus. Block 501 of method 500 includes positioning the patient transfer apparatus proximate to a patient positioned on a transfer surface. Positioning the patient transfer apparatus could include positioning the apparatus proximate to a patient bed, such as a hospital bed, a stretcher, a medical table, a surface of a full-body imaging system (e.g., an MM system), or another like surface. In some embodiments, the patient transfer apparatus could be detachably coupled to the surface so that it is secured proximate to the transfer surface while the apparatus is in use, but can be removed from the surface after use. To facilitate positioning of the patient transfer apparatus, the housing or another element of the apparatus could include an attachment mechanism. For example, the patient transfer apparatus could include one or more clamps, hook and loop fasteners, ties, adhesives, or other means for attachment. In a particular example, positioning the apparatus could include securing it to the transfer surface with a clamp.

In another embodiment, the patient transfer apparatus could be disposed on a stand (e.g., a wheeled stand, a tripod, or another support) and positioning the apparatus proximate to a patient positioned on a transfer surface could include placing or rolling the device proximate to the transfer surface. Additionally or alternatively, the patient transfer apparatus could be disposed on an armature (e.g., an armature coupled to the transfer surface or a standalone device) and positioning the apparatus could include moving the armature proximate to the patient and/or transfer surface. In some cases, the patient transfer apparatus may form part of the transfer surface or be irreversibly coupled to the transfer surface. For example, a patient bed, a hospital bed, a stretcher, or another like surface could be designed to include the patient transfer apparatus, disposed at an appropriate location relative to the patient and transfer surface. In such an example, positioning a patient transfer apparatus proximate to a patient could include positioning the patient on the transfer surface.

Once the apparatus has been positioned and/or secured proximate to the patient, the transfer sheet can be pulled across the transfer surface and under the patient. Block 502 of method 500 includes unwinding the transfer sheet from the second roller such that the transfer sheet forms a top layer and a bottom layer beneath the patient and between the patient and the transfer surface. Unwinding the transfer sheet from the second roller could include pulling the sheet in a direction away from the second roller, thereby unwinding the transfer sheet from the roller. In some examples, the retracted transfer sheet may be partially or fully wound around the first roller in addition to the second roller. In such an example, unwinding the transfer sheet from the second roller could further include unwinding the transfer sheet from the first roller.

As described in relation to the system, a first end of the transfer sheet is coupled to the first roller and a second end of the transfer sheet opposite the first end is coupled to the second roller. Pulling the sheet at a point between the first end and the second end (i.e., at a portion of the sheet between the first and second rollers) could cause the sheet unwind from the roller(s), resulting in the formation of a top layer and a bottom layer under the patient and between the patient and the transfer surface. The top layer may comprise a portion of the transfer sheet proximate to the first end (i.e., the end coupled to the first roller), while the bottom layer could comprise a portion of the transfer sheet proximate to the second end (i.e., the end coupled to the second roller). The top and bottom layer could be joined at a fold, as previously described, with both layers forming a portion of a continuous transfer sheet. The fold could be located at a midpoint of the transfer sheet (i.e., at a point between the first end and the second end) located opposite the patient transfer apparatus when the sheet is unwound from the roller(s).

To facilitate unwinding of the transfer sheet, the transfer sheet could include one or more handles, and unwinding the transfer sheet from the second roller could include pulling the transfer sheet by a handle of the sheet. The handle(s) could be disposed at an outer edge of the transfer sheet, for example, along a hem of the transfer sheet. Additionally or alternatively, handle(s) could be disposed at a midpoint of the transfer sheet (i.e., at a point between the first end and the second end of the transfer sheet, or a point disposed between the first and second rollers when the transfer sheet is fully retracted). In such a case, pulling the handle(s) could form a fold at the midpoint when the transfer sheet is unwound from the roller(s) and positioned beneath the patient and between the patient and the transfer surface.

After unwinding the transfer sheet from the roller(s) and positioning the sheet under the patient, the patient may be repositioned by moving the top layer of the sheet relative to the bottom layer of the sheet. In some examples, the top layer of the sheet may be moved by winding the transfer sheet around the first roller. Block 503 of method 500 includes winding the top layer of the transfer sheet around the first roller, thereby moving the patient in a direction toward the first roller. The transfer sheet, as previously described, may have low-friction properties on one or more surfaces of the sheet. Winding the top layer of the transfer sheet around the first roller could include sliding a low friction surface of the top layer of the transfer sheet against a low friction surface of the bottom layer of the transfer sheet.

In some cases, winding the top layer of the transfer sheet could reposition the patient on a transfer surface (e.g., causing a patient to sit upright, moving a patient from one side of the transfer surface to another side of the surface). In other situations, the apparatus may be used for moving a patient from one transfer surface to another. For example, a patient could be moved from a stretcher to a hospital bed, from a hospital bed to a full-body imaging system, or some other transfer between surfaces. In these cases, moving the patient in a direction toward the first roller could include moving a patient onto or off of a transfer surface. Additionally or alternatively, it could be desirable to move a patient in a direction other than toward the first roller. In this case, the method 500 could further include sliding the top layer of the sheet relative to the bottom layer of the sheet, thereby moving the patient relative to the transfer surface (i.e., to move them in whatever preferred direction).

Additionally or alternatively, the transfer sheet could include one or more chambers configured to receive air or some other gas, and method 500 could include inflating at least a portion of the transfer sheet in order to lift, rotate, or otherwise reposition a patient. In such examples, inflating the transfer sheet could include powering an air compressor to force air into one or more chambers disposed in the transfer sheet, After repositioning the patient (e.g., by retracting the top layer of the sheet at least partially around the first roller or by inflating a portion of the transfer sheet), the remaining portion of the sheet can then be removed from under the patient using the second roller. Block 504 of method 500 includes winding the bottom layer of the transfer sheet around the second roller, thereby retracting the transfer sheet from beneath the patient. Due to the favorable material properties of the transfer sheet, the sheet may be removed from the patient with reduced friction. Retracting the transfer sheet from beneath the patient may then be performed without needing to move the patient off of the transfer sheet, with reduced force, with fewer personnel, with reduced chance of injury, or with some other benefit.

In some examples, the apparatus could be designed or configured such that a predetermined portion of the transfer sheet is wound around the second roller and the first roller, respectively, when the sheet is fully retracted. For instance, in one embodiment, the apparatus could be configured to wind substantially the entire transfer sheet around the second roller. This would necessitate winding both the transfer sheet that remains on the transfer surface (i.e., at least the bottom layer) as well as any of the transfer sheet that has been wound around the first roller during Block 503 of the method. In such a case, winding the bottom layer of the transfer sheet around the second roller could include unwinding the transfer sheet from the first roller and winding substantially all of the transfer sheet around the second roller.

In another example, the apparatus could be configured or designed to wind a predetermined amount of the transfer sheet around the second roller (e.g., approximately one half of the sheet or another predetermined amount). Winding the predetermined amount of the sheet of the second roller could require winding or unwinding an amount of the transfer sheet on the first roller. In such an example, the method 500 could further include winding a further amount of the top layer of the transfer sheet around the first roller, thereby retracting the transfer sheet from beneath the patient; or, alternatively, unwinding an amount of the transfer sheet from the first roller, such that the predetermined amount of the transfer sheet is wound around the second roller. Other means and steps are envisioned for retracting an amount of the transfer sheet around at least the second roller.

In some examples, the apparatus could include one or more motors or other electromechanical actuators configured to apply driving and/or retracting force(s) to rotate the first and/or second roller. The motor could be a stepper motor or, in a more particular example, the motor could be a switched reluctance type stepper motor. The method 500 could include actuating the motor to wind or unwind the transfer sheet around one or more of the rollers. For example, a motor could be coupled to the first roller, and block 503 of method 500 could include actuating the motor to wind the top layer of the transfer sheet around the first roller, thereby moving the patient in a direction toward the first roller. Powering the retraction of the first roller could make it easier to reposition a patient, especially heavier patients that may be difficult to move with traditional techniques.

Additionally or alternatively, a motor could be coupled to the second roller and configured to wind or unwind the transfer sheet from the second roller. In examples where the second roller is coupled to a motor, block 504 of the method 500 could include actuating the motor to wind the bottom layer of the transfer sheet around the second roller, thereby retracting the transfer sheet from beneath the patient. Powering the winding of the transfer sheet around the second roller could facilitate retraction of the sheet from under the patient, allowing the sheet to be removed in less time, with less force, or with some other benefit. Additionally or alternatively, the motor could be used to unwind the transfer sheet from the second roller. In this case, block 502 could include actuating the motor to unwind the transfer sheet from the second roller.

In some examples, a separate motor could be used to actuate the second roller and wind/unwind the transfer sheet. Alternatively, a motor could be coupled to and used to power both the first and second rollers, and a control mechanism (i.e., a clutch) could be utilized to control the rollers independently. In such a configuration, a clutch could be coupled to the first and/or second rollers and be operable to selectively engage and disengage the rollers such that they can be controlled independently (i.e., the first roller can be powered to wind or unwind the transfer sheet without powering the second roller, and vice versa). When such a clutch is engaged, powering the motor can cause the first and/or second rollers to rotate, thereby winding or unwinding the transfer sheet. Conversely, when the clutch is disengaged from the first and/or second rollers, the respective roller(s) may rotate freely (allowing a user to, e.g., manually unwind the transfer sheet from the roller(s)).

In some examples, elements of the apparatus (e.g., the motor(s), clutch bearing(s), rollers, or air compressor) could be controlled by a user interface of the apparatus. The user interface could include one or more buttons, switches, dials, a touch pad, a display, and/or a touch screen in order to accept a user input, as described in relation to the apparatus. The method 500 could include interacting with the user interface in order to affect the operations of the motor, the clutch, the first and/or second rollers, or additional elements of the apparatus. In a particular example, the method could include: accepting, at a user interface of the apparatus, a user input; and, responsive to receiving the user input, activating the motor to actuate the first and/or second roller. Additionally or alternatively, the user interface could be configured to engage or disengage the clutch, and the method 500 could include: accepting a user input at a user interface of the apparatus; and, responsive to receiving the user input, engaging and/or disengaging a clutch of the apparatus. Other functionalities of the user interface are envisioned by one of ordinary skill in the art.

The motor(s) could further include a controller configured to control various aspects of the motor. The controller could be used to determine when the transfer sheet is wound around the roller(s) and automatically stop the motor when the transfer sheet is sufficiently wound or unwound. In one example, the controller could be operable to stop the motor when the transfer sheet has been fully wound onto the first and/or second roller, and winding the bottom layer of the transfer sheet around the second roller could comprise using the controller to stop the motor. In a particular example, the method 500 could include determining, by way of a controller, that the transfer sheet is fully wound around the first and/or second roller; and, responsive to determining that the transfer sheet is fully wound around the first and/or second roller, stopping the motor. When the apparatus is configured to wind a predetermined amount of the transfer sheet around one or more of the rollers, the controller could be used to determine the predetermined amount. The method 500 could then include determining, by way of the controller, when a predetermined portion of the transfer sheet is wound around the first and/or second rollers; and, responsive to determining that a predetermined portion of the transfer sheet is wound around the first and/or second rollers, stopping the motor. Other aspects of the motor's operations could be controlled by the controller as well. For instance, the controller could be used to enable or disable a clutch of the motor(s), to adjust a speed of rotation of the first and/or second rollers, to change a direction of the rotation of the one or more rollers, or affect some other operations of the apparatus.

Additionally or alternatively, the rotation of the first and/or second rollers could be powered manually (i.e., by a user of the apparatus). In such an example, the first and/or second rollers could be rotated by a mechanical actuator, for instance, a crank, a spring, a foot pedal, or a button. In such an example, winding the transfer sheet around the roller(s) could include using a mechanical actuator to rotate the rollers, thereby winding the transfer sheet. In an example where the mechanical actuator is coupled to the first roller, winding the top layer of the transfer sheet around the first roller could include using a mechanical actuator to wind the top layer of the transfer sheet around the first roller, thereby moving the patient in a direction toward the first roller. Additionally or alternatively, the mechanical actuator could be coupled to the second roller, and the method 500 could include using a mechanical actuator to wind the bottom layer of the transfer sheet around the second roller, thereby retracting the transfer sheet from beneath the patient. In a particular example, the mechanical actuator could include a crank coupled to the first and/or second roller(s), and the method could include turning the crank to wind or unwind the transfer sheet from the first and/or second rollers.

Similarly, retraction of the transfer sheet around the first and/or second rollers could be powered by a spring mechanism, as described in relation to the apparatus. Such a spring mechanism could function by gaining potential energy as the transfer sheet is unwound from the roller(s). For example, unwinding (e.g., pulling) the transfer sheet from the second roller could cause the spring mechanism to build up potential energy, such that a subsequent winding of the transfer sheet around the second roller can be powered by the built up energy. In such a case, the method 500 could include unwinding the transfer sheet from the first and/or second rollers, thereby causing a spring to gain potential energy. The method 500 could further include releasing the potential energy from the spring to wind the bottom layer of the transfer sheet around the second roller, thereby retracting the transfer sheet from beneath the patient.

The example method 500 illustrated in FIG. 5 is meant as an illustrative, non-limiting example. Blocks and steps described herein may be carried out sequentially or in parallel. Furthermore, the various block and steps could be carried out in a different order than described herein and some blocks and steps could be omitted, skipped, and/or repeated. Additional or alternative elements of the methods and additional or alternative components of the systems are anticipated, as will be obvious to one skilled in the art.

IV. Conclusion

The above detailed description describes various features and functions of the disclosed systems, devices, and methods with reference to the accompanying figures. While various aspects and embodiments have been disclosed herein, other aspects and embodiments will be apparent. The various aspects and embodiments disclosed herein are for purposes of illustration only and are not intended to be limiting, with the true scope being indicated by the following claims.

The present disclosure is not to be limited in terms of the particular embodiments described in this application, which are intended as illustrations of various aspects. Many modifications and variations can be made without departing from its scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims.

The above detailed description describes various features and functions of the disclosed systems, devices, and methods with reference to the accompanying figures. In the figures, similar symbols typically identify similar components, unless context dictates otherwise. The example embodiments described herein and in the figures are not meant to be limiting. Other embodiments can be used, and other changes can be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The particular arrangements shown in the figures should not be viewed as limiting. It should be understood that other embodiments can include more or less of each element shown in a given figure. Further, some of the illustrated elements can be combined or omitted. Yet further, an example embodiment can include elements that are not illustrated in the figures.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

What is claimed is:

1. A method for repositioning a patient, the method comprising:

positioning a patient transfer apparatus proximate to a patient positioned on a transfer surface, wherein the patient transfer apparatus comprises:

a first roller;

a second roller, wherein the first and the second rollers are arranged on one side of the transfer surf ace; and a transfer sheet, wherein a first end of the transfer sheet is coupled to the first roller, and wherein a second end of the transfer sheet opposite the first end is coupled to the second roller;

unwinding the transfer sheet from the second roller such that the transfer sheet forms a top layer and a bottom layer beneath the patient and between the patient and the transfer surface, wherein unwinding the transfer sheet from the second roller comprises sliding the bottom layer of the transfer sheet between the transfer surf ace and the top layer of the transfer sheet;

winding the top layer of the transfer sheet around the first roller, thereby moving the patient in a direction toward the first roller; and winding the bottom layer of the transfer sheet around the second roller, thereby retracting the transfer sheet from beneath the patient;

wherein the patient transfer apparatus further comprises a motor coupled to at least the first roller, and wherein winding the top layer of the transfer sheet around the first roller comprises actuating the motor to wind the transfer sheet around the first roller; and wherein the motor is coupled to the first roller and the second roller, and wherein the apparatus further comprises a clutch such that the motor can rotate the first roller and the second roller independently.

2. The method of claim 1, wherein the patient transfer apparatus is configured to be detachably coupled to the transfer surface, and wherein positioning the patient transfer apparatus proximate to the transfer surface comprises securing the apparatus to the transfer surface.

3. The method of claim 1, wherein the transfer surface comprises a top surface of a patient bed.

4. The method of claim 1, wherein the first end of the transfer sheet is removably coupled to the first roller, and wherein the second end of the transfer sheet is removably coupled to the second roller.

5. The method of claim 1, wherein the transfer sheet comprises one or more pockets configured to receive a gas, and wherein the method further includes forcing a gas into the one or more pockets to inflate at least a portion of the transfer sheet.

6. The method of claim 1, wherein the transfer sheet comprises a polymeric material.

7. The method of claim 1, wherein the patient transfer apparatus further comprises a controller, wherein the controller is configured to stop the motor when the transfer sheet has been fully wound onto the first and/or second roller, and wherein winding the bottom layer of the transfer sheet around the second roller comprises using the controller to stop the motor.

8. The method of claim 1, further comprising a mechanical actuator coupled to at least the first roller, wherein winding the top layer of the transfer sheet around the first roller comprises using a mechanical actuator to wind the transfer sheet around the first roller.

9. A patient repositioning system for repositioning a patient positioned on a transfer surface, the system comprising:

a first roller;

a second roller, wherein the first and the second rollers are arranged on one side of the transfer surf ace; and a transfer sheet, wherein a first end of the transfer sheet is coupled to the first roller, wherein a second end of the transfer sheet opposite the first end is coupled to the second roller, wherein the transfer sheet is configured to unwind from the second roller to form a top layer and a bottom layer beneath the patient and between the patient and the transfer surface, and wherein the bottom layer of the transfer sheet is configured to slide between the transfer surface and the top layer of the transfer sheet;

wherein the motor comprises a clutch such that the motor can rotate the first roller and the second roller independently.

10. The patient repositioning system of claim 9, wherein the transfer surface comprises a top surface of a patient bed.

11. The patient repositioning system of claim 9, wherein the transfer sheet comprises a polymeric material.

12. The patient repositioning system of claim 9, further comprising a motor coupled to at least the first roller, wherein the motor can be actuated to wind the top layer of the transfer sheet around the first roller, thereby moving the patient in a direction toward the first roller.

13. The patient repositioning system of claim 9, wherein the motor is coupled to the second roller, and wherein the motor can be actuated to wind the bottom layer of the transfer sheet around the second roller such that the transfer sheet is removed from beneath the patient.

14. The patient repositioning system of claim 9, wherein the first end of the transfer sheet is removably coupled to the first roller, and wherein the second end of the transfer sheet is removably coupled to the second roller.

15. The patient repositioning system of claim 9, further comprising a controller, wherein the controller is operable to stop the motor when the transfer sheet has been fully wound onto the first and/or second roller.

16. The patient repositioning system of claim 9, wherein the patient repositioning system is configured to be detachably coupled proximate to the transfer surface.

17. A patient repositioning system for repositioning a patient positioned on a transfer surface, the system comprising:

a first roller;

a second roller, wherein the first and the second rollers are arranged on one side of the transfer surf ace; and a transfer sheet, wherein a first end of the transfer sheet is coupled to the first roller, wherein a second end of the transfer sheet opposite the first end is coupled to the second roller, wherein the transfer sheet is configured to unwind from the second roller to form a top layer and a bottom layer beneath the patient and between the patient and the transfer surface, and wherein the bottom layer of the transfer sheet is configured to slide between the transfer surface and the top layer of the transfer sheet;

wherein the transfer sheet comprises a further layer adhered to the top layer of the transfer sheet to form at least one pocket between the top layer and the further layer, wherein the transfer sheet is configured to receive a gas into the pocket to inflate at least a portion of the transfer sheet.

* * * * *